US006957785B2

(12) United States Patent
Virving

(10) Patent No.: US 6,957,785 B2
(45) Date of Patent: Oct. 25, 2005

(54) REFINING SEGMENT FOR A ROTATABLE REFINING DISC, AND A REFINING APPARATUS COMPRISING A REFINING DISC WITH SUCH REFINING SEGMENT

(75) Inventor: Nils Virving, Hässelby (SE)

(73) Assignee: Valmet Fibertech AB (SE)

( * ) Notice: Subject to any disclaimer, the term of this patent is extended or adjusted under 35 U.S.C. 154(b) by 196 days.

(21) Appl. No.: 10/297,516

(22) PCT Filed: Jun. 7, 2001

(86) PCT No.: PCT/SE01/01282

§ 371 (c)(1),
(2), (4) Date: May 28, 2003

(87) PCT Pub. No.: WO01/94020

PCT Pub. Date: Dec. 13, 2001

(65) Prior Publication Data

US 2003/0189117 A1 Oct. 9, 2003

(30) Foreign Application Priority Data

Jun. 8, 2000 (SE) ..... 0002154

(51) Int. Cl.[7] ..... B02C 7/11

(52) U.S. Cl. ..... 241/166; 241/261.2; 241/298

(58) Field of Search ..... 241/261.2, 261.3, 241/296, 297, 298, 166

(56) References Cited

U.S. PATENT DOCUMENTS 2,145,851 A * 2/1939 Asplund ..... 162/236
4,878,997 A * 11/1989 Reinhall ..... 162/23
5,200,038 A * 4/1993 Brown ..... 162/261
5,725,306 A * 3/1998 Kappel et al. ..... 366/157.1

* cited by examiner

*Primary Examiner*—Mark Rosenbaum
(74) *Attorney, Agent, or Firm*—Lerner, David, Littenberg, Krumholz & Mentlik, LLP

(57) ABSTRACT

Apparatus for use as a portion of a refining surface of a rotatable refining disk is disclosed. The apparatus includes a refining segment having a periphery and being mountable on a rotatable refining disk in juxtaposition with an opposing refiner disk for treating lignocellulosic material in the gap between the disks, and at least one cleaner protruding from the periphery of the refining segment between that periphery and the refiner housing surrounding the refiner whereby lignocellulosic material is cleared from the outer periphery of the refining disk upon its rotation.

12 Claims, 5 Drawing Sheets

REFINING SEGMENT FOR A ROTATABLE REFINING DISC, AND A REFINING APPARATUS COMPRISING A REFINING DISC WITH SUCH REFINING SEGMENT

FIELD OF THE INVENTION

The present invention relates to a refining segment constituting at least part of a rotatable refining disk included in refining apparatus for disintegrating and refining material containing lignocellulose in a refining gap between two opposing refining disks rotatable in relation to each other. More particularly, the present invention relates to refining apparatus comprising a refining disk that includes one or more such refining segments.

BACKGROUND OF THE INVENTION

Refining apparatus or disk refiners of the above-described type are used, for instance, for highly concentrated refining, CTMP, TMP, fluffing and highly concentrated grinding of sack paper and other fibrous material containing lignocellulose. They usually comprise a rotatable refining disk, mounted on a rotor, and a non-rotatable refining disk, mounted on a stator. Refining disks in this type of refining apparatus are composed of refining segments that form refining surfaces. The refining segments are replaced at regular intervals due to considerable wear. They are either mounted directly on the rotor and stator, respectively, or by means of special segment holders. A refining disk may consist of one or more annular refining segments or of several divided, radial refining segments. Refining segments may be in the form of central segments and peripheral segments, the peripheral segments being located outermost along the periphery, and the central segments being located inside the peripheral segments. Between the refining disk/surfaces on the rotor and stator, respectively, is a space in the form of a refining gap.

A serious problem with this type of refining apparatus, particularly when the apparatus first starts up, is that fiber often builds up to a pulp cake between the rotatable parts and the surrounding refiner housing. This pulp cake sometimes tends to become lodged and completely blocks transport of fibers to the outlet. Besides this obvious drawback, the build-up of pulp in the refiner housing also results in a high degree of friction along the periphery of the rotatable parts, due to the high rate of rotation, and also considerable generation of heat which may cause the fibers to carbonize, becoming so hard that the rotor is turned as by a lathe, and may cause breakdown. Even if these problems do not reach this stage, the build-up of pulp causes continuous wear on the outer part of the rotor and the segment holders of the refining disk when used, so that they may break down in the end. The heat generation may also be so high that the rotor and/or the segment holder may melt. According to conventional technology attempts to eliminate these problems entail providing the rotor itself with wings that protrude into the space between the rotor and the outer wall of the refiner housing to keep it clean. However, these wings often give rise to cavitation damage in the attachment between wing and rotor, which may lead to the wing gradually becoming dislodged, with disastrous consequences. To avoid this, regular maintenance must be undertaken, which is naturally associated with costs.

One object of the present invention is to remedy the problems mentioned above.

SUMMARY OF THE INVENTION

In accordance with the present invention, this and other objects have now been realized by the invention of apparatus for use as at least a portion of a refining surface of a rotatable refining disk having an outer periphery and rotatable in a predetermined direction of rotation for use in a refiner for lignocellulosic material disposed within a refiner housing, the apparatus comprising a refining segment having a periphery and being mountable on the rotatable refining disk in juxtaposition with an opposing refiner disk with a refining gap therebetween for treating the lignocellulosic material, and at least one cleaning member protruding from the periphery of the refining segment between the periphery of the refining segment and the refiner housing whereby lignocellulosic material is cleared from the outer periphery of the refining disk upon rotation thereof. Preferably, the at least one cleaning member comprises a first portion having an outer end protruding substantially radially from the outer periphery of the refining disk and a second portion disposed at the outer end of the first portion at an angle with respect to the predetermined direction of rotation and with respect to the first portion of the at least one cleaning member. In a preferred embodiment, the second portion of the at least one cleaning member is shaped to extend at least partially in a direction substantially parallel to the axis of rotation of the rotatable refining disk.

In accordance with one embodiment of the apparatus of the present invention, the second portion of the at least one cleaning member includes a forward portion extending in a direction along the periphery of the opposing refining disk.

In accordance with yet another embodiment of the apparatus of the present invention, the second portion of the at least one cleaning member includes a rearward portion extending in a direction along the outer periphery of the rotatable refining disk.

In accordance with another embodiment of the apparatus of the present invention, the at least one cleaning member comprises a first portion having an outer end protruding substantially radially from the outer periphery of the refining disk, and a second portion disposed at the outer end of the first portion and extending substantially radially therefrom.

In accordance with another embodiment of the apparatus of the present invention, the at least one cleaning member has a streamlined configuration.

In accordance with another embodiment of the apparatus of the present invention, the at least one cleaning member comprises a unitary member separate from and attached to the refining segment.

In accordance with another embodiment of the apparatus of the present invention, the at least one cleaning member comprises a portion of the refining segment unitary therewith.

In accordance with another embodiment of the apparatus of the present invention, the refining segment comprises a radial refining segment.

In accordance with another embodiment of the apparatus of the present invention, the refining segment comprises an annular refining segment and includes a pair of the cleaning members diametrically opposed to each other thereon.

In accordance with the present invention, apparatus has also been discovered for refining and disintegrating lignocellulosic material comprising first and second opposing refining disks rotatable with respect to each other, juxtaposed with a refining gap therebetween and disposed within a refiner housing, the first refining disk comprising a rotatable refining disk having an outer periphery and rotatable in a predetermined direction of rotation, a refining segment having a periphery and mounted on the rotatable refining disk, and at least one cleaning member protruding from the periphery of the refining segment between the periphery of the refining segment and the refiner housing whereby lignocellulosic material is cleared from the outer periphery of the refining disk upon rotation thereof.

The objects of the present invention are achieved by making use of a refining segment provided with at least one cleaning member for clearing away material that has collected outside the outer edge of the refining disk. Thus, in accordance with the present invention, the refining segment is provided with a cleaning member instead of the actual rotor being provided with a cleaning member in the form of a wing. As mentioned above, the refining segment on the rotor is replaced at regular intervals and the cleaning member joined to the refining segment is thus also replaced long before any risk of serious damage arises.

In accordance with a preferred feature of the present invention, the cleaning member is made in one piece with the refining segment, preferably by means of casting.

The present invention has the advantage of being applicable to refining apparatus both of the "single disk" type with a rotatable refining disk and a stationary refining disk, and of the "double disk" type with two refining disk rotating against each other.

In accordance with the present invention a refining apparatus is also provided with a refining disk having such refining segments.

BRIEF DESCRIPTION OF THE DRAWINGS

The present invention will now be described with reference to the accompanying detailed description, which, in turn, refers to the drawings, illustrating embodiments of the present invention by way of example, in which.

DETAILED DESCRIPTION

Figure 1:
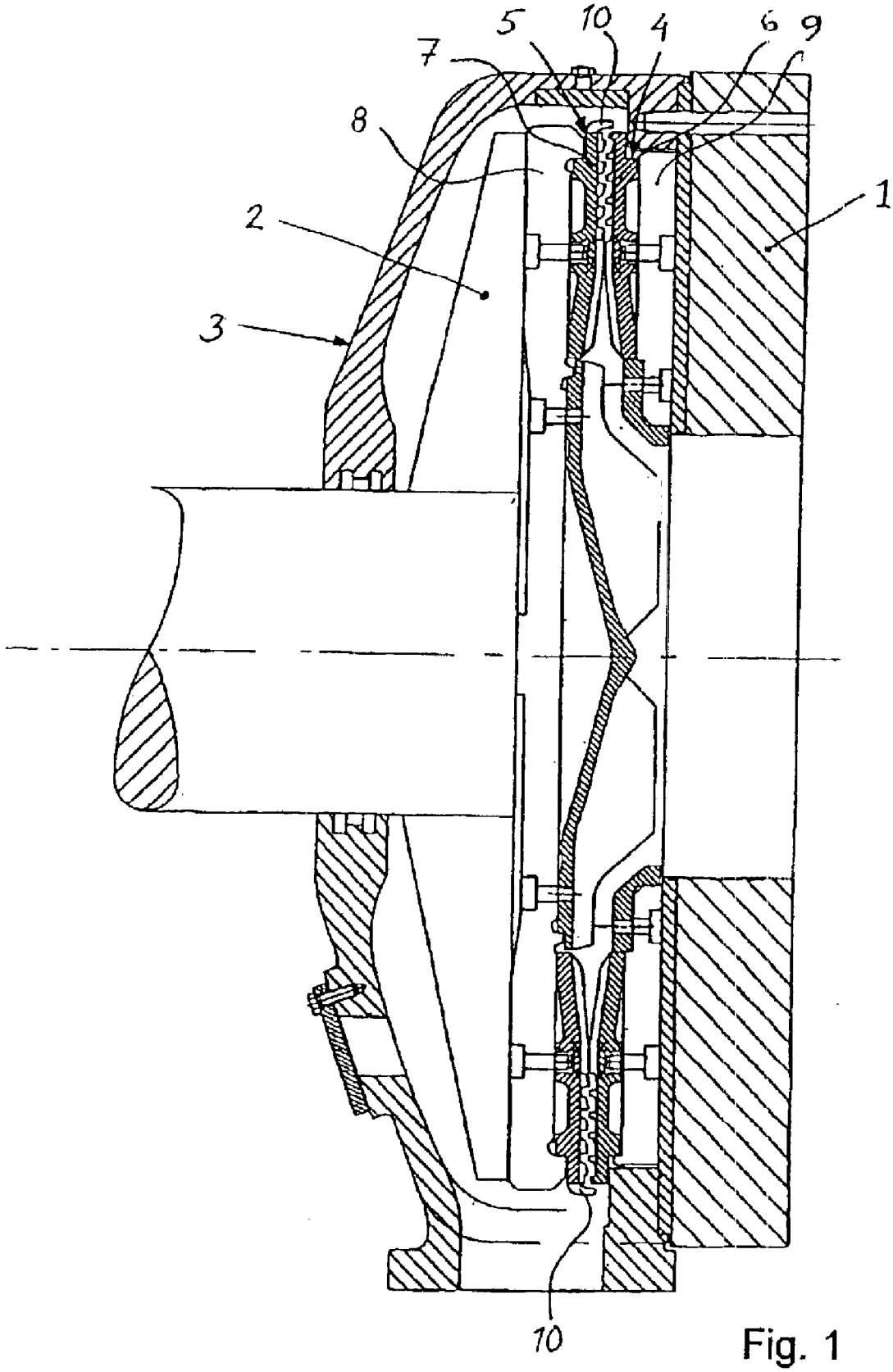
FIG. 1 is a side, elevational, cross-sectional view, of a disk refiner in accordance with the present invention.

Referring to the drawings, FIG. 1 illustrates a disk refiner comprising a stationary part, stator 1, and a rotatable part, rotor 2, arranged in a refiner housing 3. Refining disks, 4 and 5, are mounted on the stator and rotor, respectively. These refining disks are generally divided into segments, known as refining segments or stator segments 6 and rotor segments 7, respectively, forming refining surfaces. The refining segments are normally pre-fitted on segment holders, 8 and 9, respectively, in order to enable quick exchanging, but may also be fitted directly on the rotor or stator. The number of segments may vary, as mentioned above. A rotor refining disk generally has eight, twelve or eighteen segments. Whole, i.e. undivided, refining disks are also possible, particularly in small refineries. The stator usually has refining segments corresponding to those of the rotor.

A refining gap is produced between the refining surfaces, where the material fed into the refiner is refined.

Figure 2:
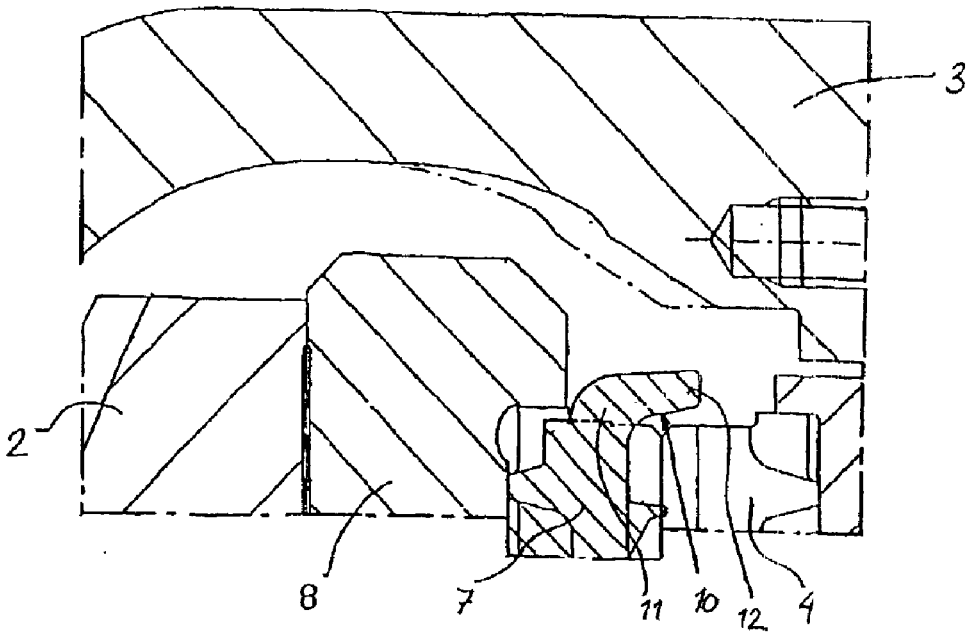
FIG. 2 is a partial side, elevational, cross-sectional enlarged view, of a disk refiner having a refining segment in accordance with a first embodiment of the present invention.

FIG. 2 illustrates a first embodiment of a refining segment in accordance with the present invention. This refining segment 7 is mounted on a segment holder 8 pertaining to a rotor 2 in the refining apparatus. The refining segment is provided at its periphery with a cleaning member 10 in the form of a "wing" to prevent and remove the pulp cake that would otherwise be formed between the rotating parts and the refiner housing. This cleaning member 10 or wing may be said to comprise a first radial holder part 11 and a second part 12 arranged at the outer end of the first part 11 and constituting the true cleaning element which is angled in the direction of rotation, preferably in a non-radial plane. Its angle in relation to the direction of rotation is preferably about 90°, and its angle in relation to the radial direction is also preferably about 90°, as illustrated in FIG. 2. Alternatively, it may be described as forming an angle in the order of 90° in relation to the refining surface. In accordance with this embodiment, thus, the cleaning element 12 is thus angled towards the opposing refining disk. It may naturally be angled so that it is parallel with the direction of the axis of rotation, but it may also have an angle in relation to the direction of the axis of rotation. The cleaning member is preferably streamlined in order to reduce turbulence and thereby avoid cavitation. It may, for instance, have a rounded forward edge, possibly on both sides so that it is reversible. This can be seen most clearly in FIGS. 4 and 5.

Figure 3:
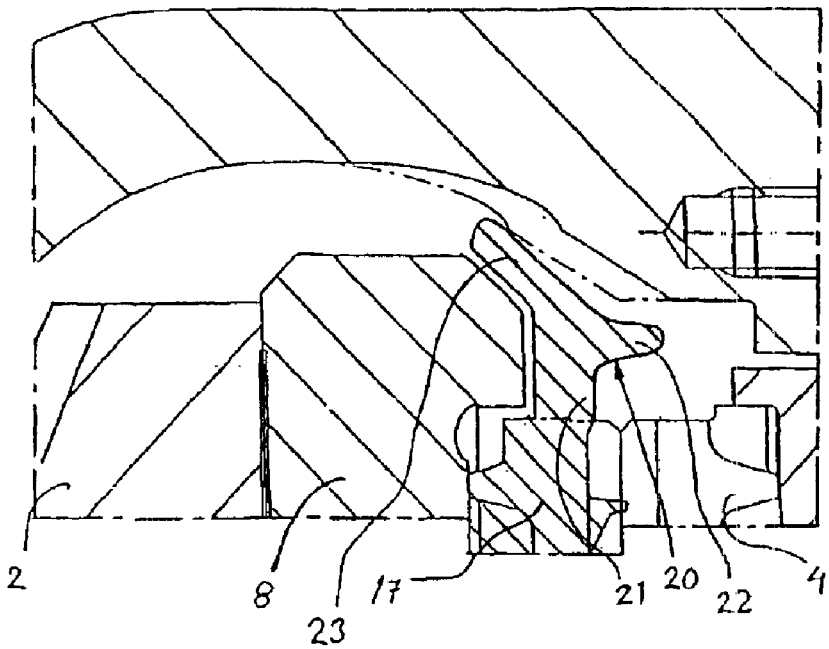
FIG. 3 is a partial side, elevational, cross-sectional view, corresponding to FIG. 2, but illustrating a second embodiment of a refining segment in accordance with the present invention.

FIG. 3 illustrates a second embodiment of a refining segment in accordance with the present invention. This refining segment 17 is provided with a wing or cleaning member 20, here provided with a holder part 21 and two protruding portions, 22 and 23, forming cleaning elements. One portion 23 protrudes substantially rearwards in a direction along the periphery of the refining disk on which the cleaning member is arranged and the other portion 22 protrudes substantially forwards in a direction along the periphery of the opposing refining disk.

Figure 4:
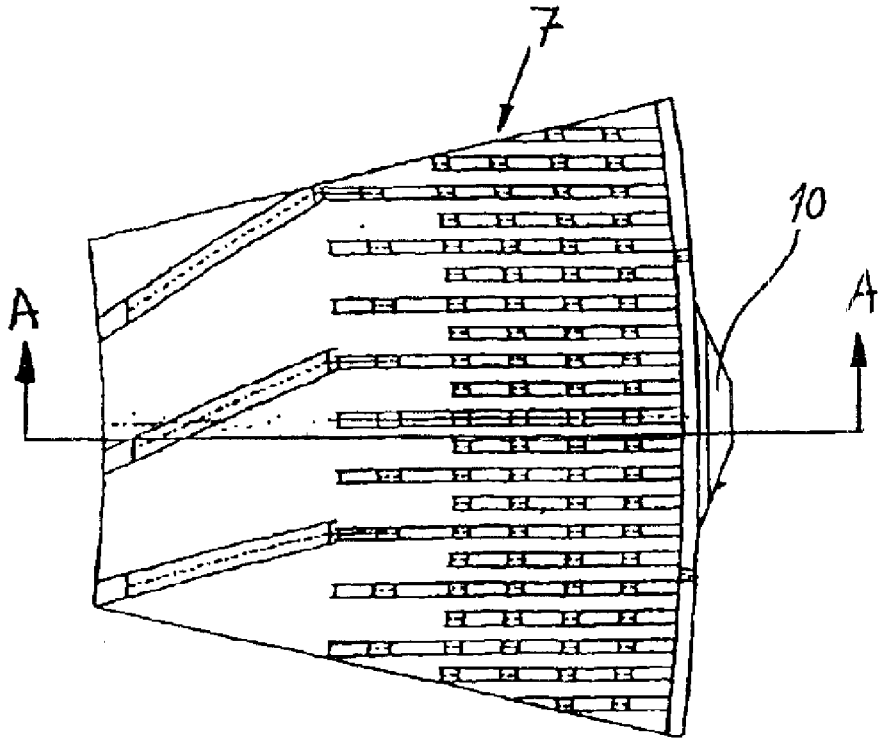
FIG. 4 is a top, elevational view of a refining segment in accordance with the present invention, in accordance with the first embodiment shown in FIG. 2.
Figure 5:
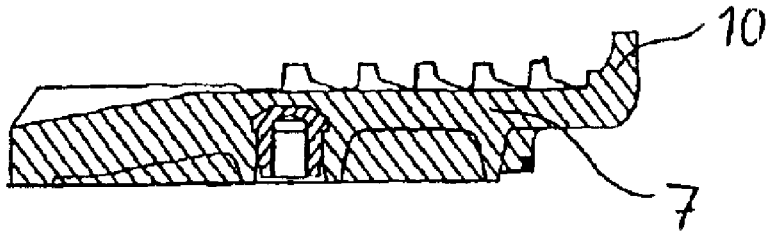
FIG. 5 is a side, elevational, cross-sectional view of the refining segment in FIG. 4, taken along the line A—A thereof, or alternatively the refining segment in FIG. 9 below, taken along the line B—B thereof.

FIGS. 4 and 5 illustrate in more detail a refining segment 7 in accordance with the first embodiment of the present invention, provided with a wing-shaped cleaning member 10. A "divided" refining segment or radial refining segment is seen here, designed to be placed along the periphery of the refining disk and which, together with a number of other segments, forms the refining disk. A radial refining segment might naturally also have cleaning members designed in accordance with the second embodiment.

Figure 6:
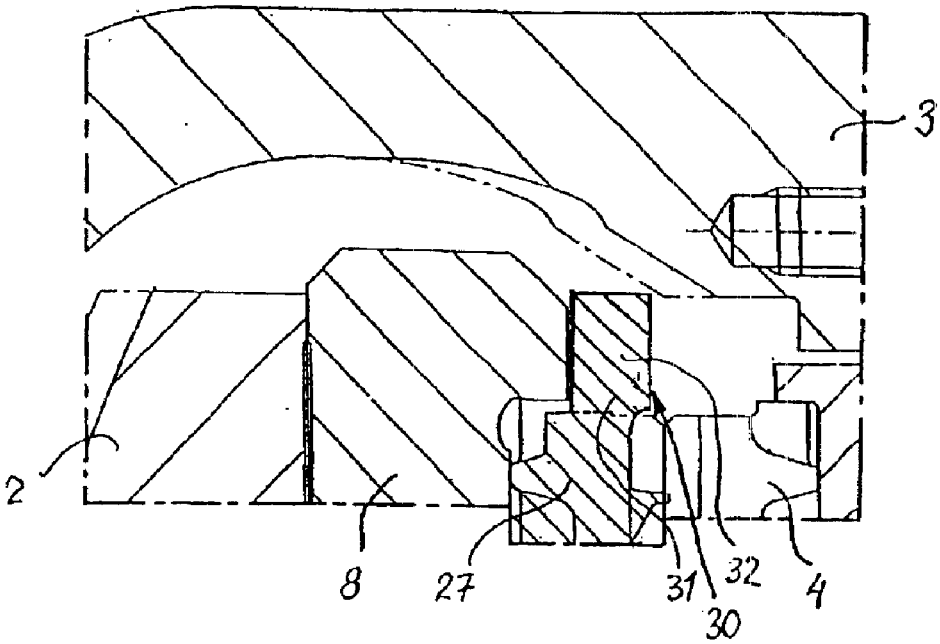
FIG. 6 is a side, elevational, partial cross-sectional view corresponding to FIGS. 2 and 3, but illustrating a third embodiment of a refining segment in accordance with the present invention.
Figure 7:
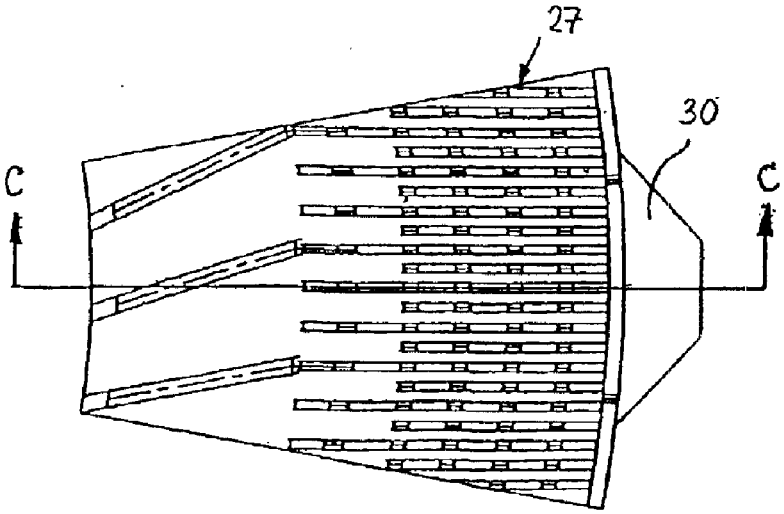
FIG. 7 is a top, elevational view of a refining segment in accordance with the present invention, in accordance with the third embodiment shown in FIG. 6.
Figure 8:
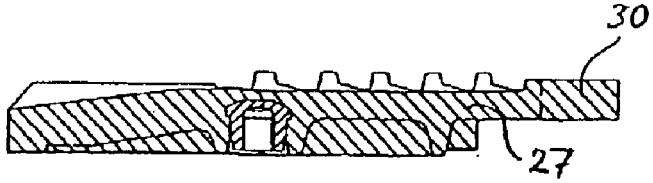
FIG. 8 is a side, elevational, cross-sectional view of the refining segment in FIG. 7, taken along the line C—C thereof.

FIG. 6 shows schematically a third embodiment of a refining segment 27 in accordance with the present invention, in a view analogous with FIGS. 2 and 3. This refining segment is shown in detail in a view from above in FIG. 7 and a cross sectional view in FIG. 8. In accordance with this third embodiment the refining segment is provided with a cleaning member 30 comprising a holder part 31 and a cleaning element 32 which here protrudes in radial direction, i.e. it is not angled in relation to the refining surfaces.

The number of refining segments having the specially designed cleaning member in accordance with the present invention may vary. In the case of radial segments it is possible to have only one segment with a cleaning member along the periphery of the refining disk, the remaining refining segments then being of standard type without cleaning members. However, to achieve good balance it may be preferable to have two refining segments with cleaning members arranged diametrically opposite each other. It is also possible to have four segments or more with cleaning members, and the remainder without.

Figure 9:
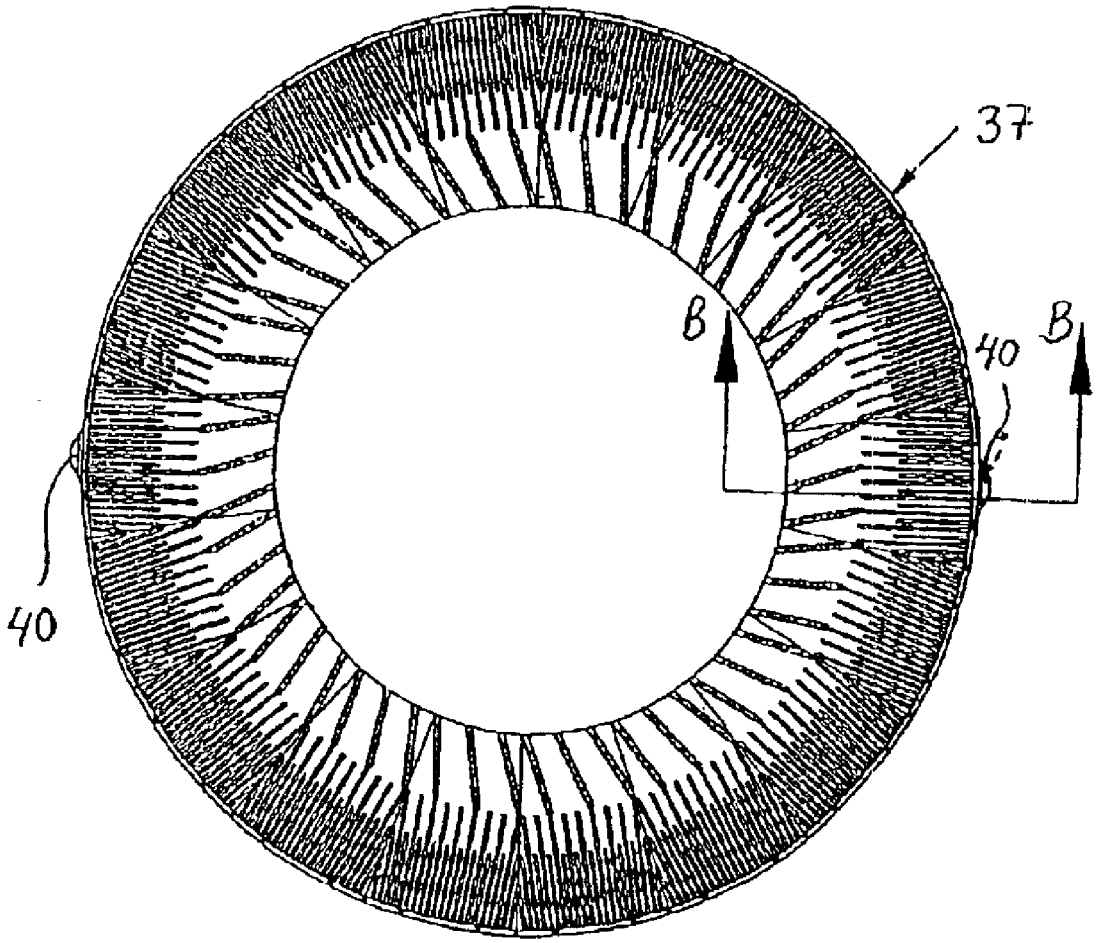
FIG. 9 is a top, elevational view of a variant of a refining segment in accordance with the present invention.

FIG. 9 illustrates a corresponding refining segment 37 which is annular. In this case the refining segment is provided with two diametrically opposed cleaning members 40, designed in accordance with the first embodiment shown in FIGS. 1 and 2. A cross section of this refining segment is as illustrated in FIG. 5. Naturally, here also, the cleaning member might be designed as shown in FIG. 3 or in FIG. 6.

When the refining segment is annular in shape it is also possible to have only one cleaning member. However, from the balance aspect at least two cleaning members are preferred.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for use as at least a portion of a refining surface of a rotatable refining disk having an outer periphery and rotatable in a predetermined direction of rotation for use in a refiner for lignocellulosic material disposed within a refiner housing, said apparatus comprising a refining segment having a periphery and mountable on said rotatable refining disk in juxtaposition with an opposing refiner disk with a refining gap therebetween for treating said lignocellulosic material, said refining segment being a wear detail that is replaceable at regular intervals; and at least one cleaning member protruding from said periphery of said refining segment between said periphery of said refining segment and said refiner housing whereby lignocellulosic material is cleared from said outer periphery of said refining disk upon rotation thereof.

2. The apparatus of claim 1 wherein said at least one cleaning member comprises a first portion having an outer end protruding substantially radially from said outer periphery of said refining disk and a second portion disposed at said outer end of said first portion at an angle with respect to said predetermined direction of rotation and with respect to said first portion of said at least one cleaning member.

3. The apparatus of claim 2 wherein said second portion of said at least one cleaning member is shaped to extend at least partially in a direction substantially parallel to the axis of rotation of said rotatable refining disk.

4. The apparatus of claim 2 wherein said second portion of said at least one cleaning member includes a forward portion extending in a direction along the periphery of said opposing refining disk.

5. The apparatus of claim 2 wherein said second portion of said at least one cleaning member includes a rearward portion extending in a direction along said outer periphery of said rotatable refining disk.

6. The apparatus of claim 1 wherein said at least one cleaning member comprises a first portion having an outer end protruding substantially radially from said outer periphery of said refining disk, and a second portion disposed at said outer end of said first portion and extending substantially radially therefrom.

7. The apparatus of claim 1 wherein said at least one cleaning member has a streamlined configuration.

8. The apparatus of claim 1 wherein said at least one cleaning member comprises a unitary member separate from and attached to said refining segment.

9. The apparatus of claim 1 wherein said at least one cleaning member comprises a portion of said refining segment unitary therewith.

10. The apparatus of claim 1 wherein said refining segment comprises a radial refining segment.

11. The apparatus of claim 1 wherein said refining segment comprises an annular refining segment and includes a pair of said cleaning members diametrically opposed to each other thereon.

12. Apparatus for refining and disintegrating lignocellulosic material comprising first and second opposing refining disks rotatable with respect to each other, juxtaposed with a refining gap therebetween and disposed within a refiner housing, said first refining disk comprising a rotatable refining disk having an outer periphery and rotatable in a predetermined direction of rotation, a refining segment having a periphery and mounted on said rotatable refining disk, said refining segment being a wear detail that is replaceable at regular intervals, and at least one cleaning member protruding from said periphery of said refining segment between said periphery of said refining segment and said refiner housing whereby lignocellulosic material is cleared from said outer periphery of said refining disk upon rotation thereof.

* * * * *